United States Patent [19]

Rohde et al.

[11] Patent Number: 4,976,127

[45] Date of Patent: Dec. 11, 1990

[54] DOUBLE ROLLER CROSSROLLING MILL FOR PIERCING AND STRETCHING OF SOLID AND HOLLOW BLOCKS

[75] Inventors: Johann H. Rohde, Ratingen; Hans Meurer, Mönchengladbach, both of Fed. Rep. of Germany

[73] Assignee: Mannesmann Aktiengesellschaft, Dusseldorf, Fed. Rep. of Germany

[21] Appl. No.: 382,780

[22] PCT Filed: Dec. 21, 1987

[86] PCT No.: PCT/DE87/00606

§ 371 Date: Jun. 23, 1989

§ 102(e) Date: Jun. 23, 1989

[87] PCT Pub. No.: WO88/04583

PCT Pub. Date: Jun. 30, 1988

[51] Int. Cl.[5] ..... B21B 31/04

[52] U.S. Cl. ..... 72/95

[58] Field of Search ..... 72/95, 96, 97, 99, 100

[56] References Cited

U.S. PATENT DOCUMENTS 1,514,425 11/1924 Brock ..... 72/95

3,948,072 4/1976 Aramaki ..... 72/225

*Primary Examiner*—Lowell A. Larson

*Attorney, Agent, or Firm*—Cohen, Pontani & Lieberman

[57] ABSTRACT

A two-high inclined-roll mill for the piercing and stretching of a solid and hollow work piece along a rolling axis includes a roll housing composed of two detachable housing halves; two rolls defining therebetween a feed angle are displaceably mounted each in one housing half; the housing halves are connected for relative movement towards each other around a common axis which perpendicularly intersects the rolling axis so as to effect adjustment of the feed angle of the rolls.

12 Claims, 4 Drawing Sheets

DOUBLE ROLLER CROSSROLLING MILL FOR PIERCING AND STRETCHING OF SOLID AND HOLLOW BLOCKS

TECHNICAL FIELD

The invention relates to a double roller crossrolling mill for the piercing and stretching of solid and hollow billets or blocks having adjustable rolls mounted within the roll housing.

BACKGROUND ART

Inclined or oblique roll mills, sometimes also called inclined twin rolling mill, double roller controlling mill or Mannesmann-type roll mill have been used for many years, in particular, for the production of seamless steel pipes. The apparatus has been continuously improved and developed and the present state of the art is represented by German Pat. No. 21 56 595. The roll stand of the apparatus disclosed in said patent is provided with two-high rolls which are positioned one above the other and with laterally arranged guide disks which can be swung out and are adjustable. The rolls are adjustably mounted in vertical direction in roll frames which are contained in a roll housing. The adjustment of the roll frame is effected by two motor-driven threaded spindles each, which are held, free of play, by a hydraulic retainer cylinder.

The so-called feed angle of the rolls which causes the helical movement of the work piece being rolled is adjustable. For this purpose, the roll frames are developed as drums which can rotate in the stand housing. The feed angle can, in this way, be indefinitely adjusted unless the roll frames are shifted, in a simplified embodiment, by shims. In such a case, the feed angle is not indefinitely adjustable; furthermore, the conversion of the roll stand is time-consuming.

This construction of known two-high inclined-roll mills is disadvantageous since the size of the roll frame requires a roll housing of considerable height which, measured overall, may amount to 8 to 10 meters. Due to the predetermined distance of the roll center above the mill floor, the housing of the rolling mill is placed in a deep foundation pit. As a result, the conduits for leading away the cooling water must also be arranged far below the mill floor. Since a internal tool such as a piercing mandrel or the like, is in most cases, used during the inclined-rolling process, this tool being supported in a thrust bearing via a mandrel support bar, the forces of reaction occurring in this connection must be absorbed by the relatively tall housing columns, which leads to considerable bending thereof.

Furthermore, due to the large size of the mill housing, stretching of the housing columns resulting from the rolling forces must be expected, which increases the roll nip and renders the dimensions of the work pieces being rolled non-uniform.

The dimensioning of the housing of the roll mill and the use of the roll frames furthermore result in a complicated and expensive removal of the rolls, prior to which heavy stand covers and window flaps must be loosened, swung away or completely removed in order to gain access to the roll frames. For this, a crane or a separate change apparatus is required; the removal is time-consuming and mechanically expensive.

Proceeding from the state of the prior art and the disadvantages described above, an object of the present invention is to create a two-high inclined-roll mill which does not have the disadvantages described above and, while of low constructural height and low lengthening, enables a simple and rapid change of rolls or stands at only slight mechanical expense.

SUMMARY OF THE INVENTION

In order to obtain this and other objects, the roll housing is divided into two housing halves which each receive one roll and possibly the respective chocks thereof and which are detachably connected to each other. In addition, the housing halves are swingable, for the adjustment of the feed angle of the rolls, around a common axis which intersects the axis of the part being rolled at a right angle. Between the housing halves which can be swung toward each other, there is preferably provided a stationary central frame which is attached to the foundation. With two-high inclined-roll mills of this type, the structural height can be made substantially lower since the large roll frames are eliminated. The adjustment of the feed angle can be effected in infinitely varied manner due to the fact that the housing halves and the rolls which are mounted in the chocks of the housing halves can be swung toward each other. In this way, the total height of the roll stand can, with the same diameter of the rolls, be reduced by about 50%. Consequently, there is also a reduction in weight of at least about 50%.

In accordance with another object of the invention, the connection of the housing halves is effected by means of pretensioned tie rods, which pass through the housing halves on both sides of the axis of the work piece being rolled. Between the tie rods and the bores in the housing halves passed through by them, there is present a lateral play which renders a turning of the housing halves possible.

The relatively short tie rods which pre-tension the stand minimize the spring action of the stand to such an extent that substantially improved tolerances of the work piece being rolled can obtained.

In a two-high inclined-roll mill with central frame according to the invention, the tie rods passing through and connecting the housing halves can be developed as stay bolts which are fastened to the central frame on both sides. The pretensioning of the housing halves with respect to each other and with respect to the central frame, respectively, can be achieved in known manner by means of hydraulic tensioning nuts; the pretensioning is eliminated before the rotating of the halves against each other.

In accordance with another object of the invention, the tie rods passing through the center frame are mounted rotatably therein and each housing half is provided on both ends in the region of the bores passed through by said tie rods with threads of different direction of pitch. Adjusting nuts with corresponding counter threads are arranged in the housing halves. This arrangement enables a favorable adjustment of the roll nip by turning the tie rods the different threads of which cause the housing halves to move apart or together. All tie rods of this type can be actuated by a common drive.

In a preferred embodiment of the invention the bores of the center frame are provided, in the region of their ends facing the housing halves, with threads of different direction of pitch. Within these threads ar disposed in rotatable and axially displaceable manner thread bushings having corresponding outer threads. The thread bushings correspond on their inner sides with multi-wedge profiles which are provided on the tie rods; and the tie rods are mounted in rotatable manner for the displacement in opposite direction of the thread bushing whose end sides act on the thread halves to effect a moving together or apart; and at least one end of the tie rod is cooperating with a piston-cylinder unit by means of which the pre-tensioning force of the stand can be applied. This embodiment enables both the positioning of the housing halves with respect to each other as well as the pre-tensioning via the tie rods. The adjustment mechanism for the synchronously opposite turning of the housing halves rests, in accordance with a further object of the invention, on the foundation of the roll stand and/or the central frame. The adjustment can take place by synchronously operated piston-cylinder units, gears, opposed cams or the like.

In a preferred embodiment of the invention the central frame receives the known guides for the work piece being rolled such as entry and exit guides, lateral guides, swivel arms for Diescher-disks or the like. These parts can remain in place together with the central frame during the changing of the rolls.

The change of the rolls takes places, in accordance with another preferred embodiment of the invention, after loosening the connection between the housing halves in the manner that at least one of the rolls and its chocks can be removed together with the corresponding housing half. In this way, the removed housing half can be replaced as fast as possible by another housing half which has already been prepared, after the second chock with the backing roll has been replaced by another one.

In accordance with a particularly advantageous embodiment of the invention, the chocks of the two rolls are connected to each other for the removal of both rolls and their chocks together with one housing half. This way the replacement time can be further shortened. It is, of course, also possible to replace the entire roll stand.

The plane of separation between the housing halves can be either horizontal or vertical.

The present invention provides not only a two-high inclined-roll mill of reduced height and weight, but the lengthening o stretching under the rolling force is also considerably reduced. By reducing the replacement time for the rolls as a result of the simple structural development of the present rolling mill, it is possible, together with the other features of the invention, to obtain better wall thickness tolerances upon the production of tubes and to improve the output of the rolling mill due to the fact that the downtimes for the changing of a roll are reduced.

BRIEF DESCRIPTION OF THE DRAWINGS

One embodiment of the present invention is described below in connection with the drawings in which.

DETAILED DESCRIPTION OF THE PRESENTLY PREFERRED EMBODIMENT

Figure 1:
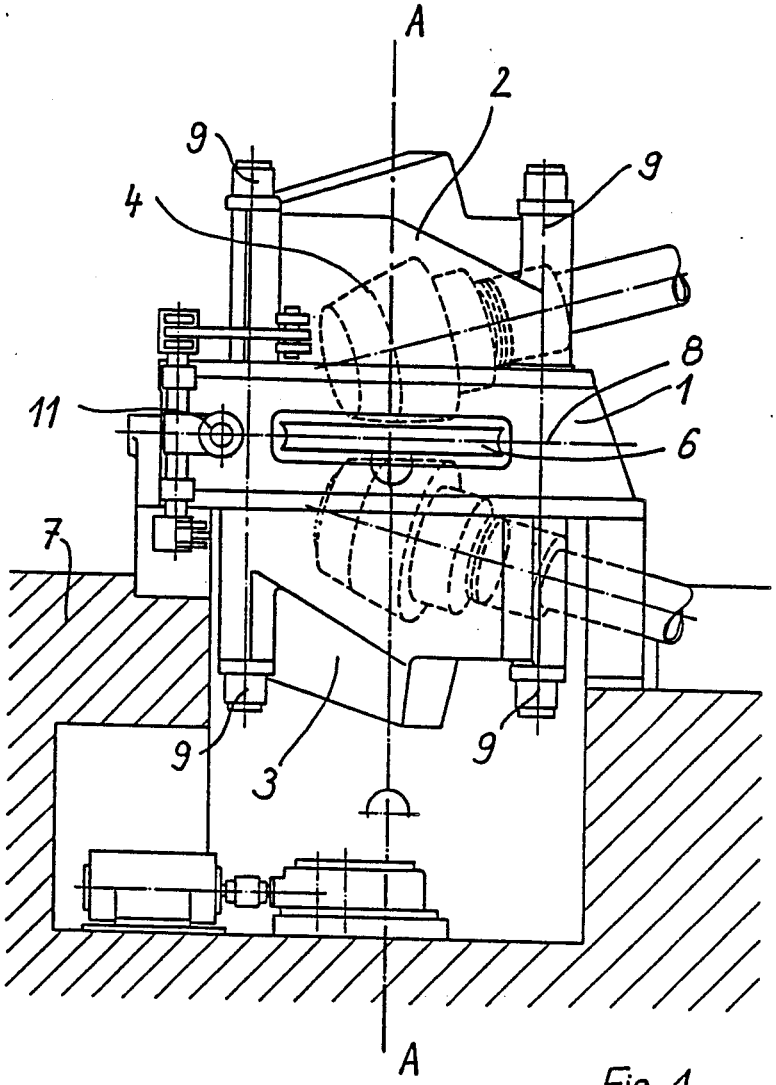
FIG. 1 is a side view of a two-high included-roll mill according to the invention.

In FIG. 1, numeral 1 designates the central frame mounted to the foundation 7, the frame bearing the upper housing half 2 and the lower housing half 3 of the two-high inclined-roll mill of the invention. The rolls bear the reference number 4 (upper roll) and 5 (lower roll). 6 is one of the two guide disks which are mounted by means of known swivel arms on the central frame 1. The rolling axis is indicated with the numeral 8 in FIG. 1. The upper housing half 2 and the lower housing half 3 are held together by means of tie rods 9, four of which are provided on both sides of the axis of the work piece being rolled, suitably with pre-tension.

Figure 2:
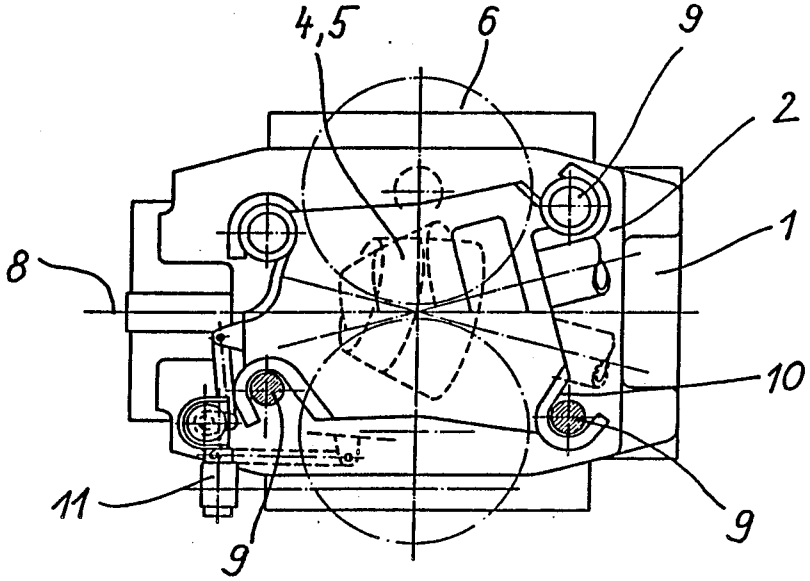
FIG. 2 is a top view of the roll of FIG. 1.

As can be noted from the top view of FIG. 2, the housing halves 2, 3 surround the tie rods 9 with correspondingly larger bores 10 which are open at one end and thus permit a turning of the housing halves 2 and 3 in each case in opposite direction around the common axis A—A. The bores 10 for tie rods 9 in the upper housing half are open at one end thereof and thus permit, after previously loosening of the tie rods and turning of the housing halves to a feed angle of 0, the removal thereof without the disassembly of other parts. The positioning gears 16 (FIG. 3) are in this case provided in the lower housing half. Since the rolls 4 and 5 are each mounted in the corresponding housing halves in known manner in chocks 23, 24 (FIG. 4), the rolls are adjusted by turning the housing halves. This can be effected, after loosening the pre-tensioning force maintained during the rolling, by means of the swing drives shown at 11 which, resting on the central frame 1, turn the upper housing half in one direction and the lower housing half in the other direction with respect to the stationary central frame.

Figure 3:
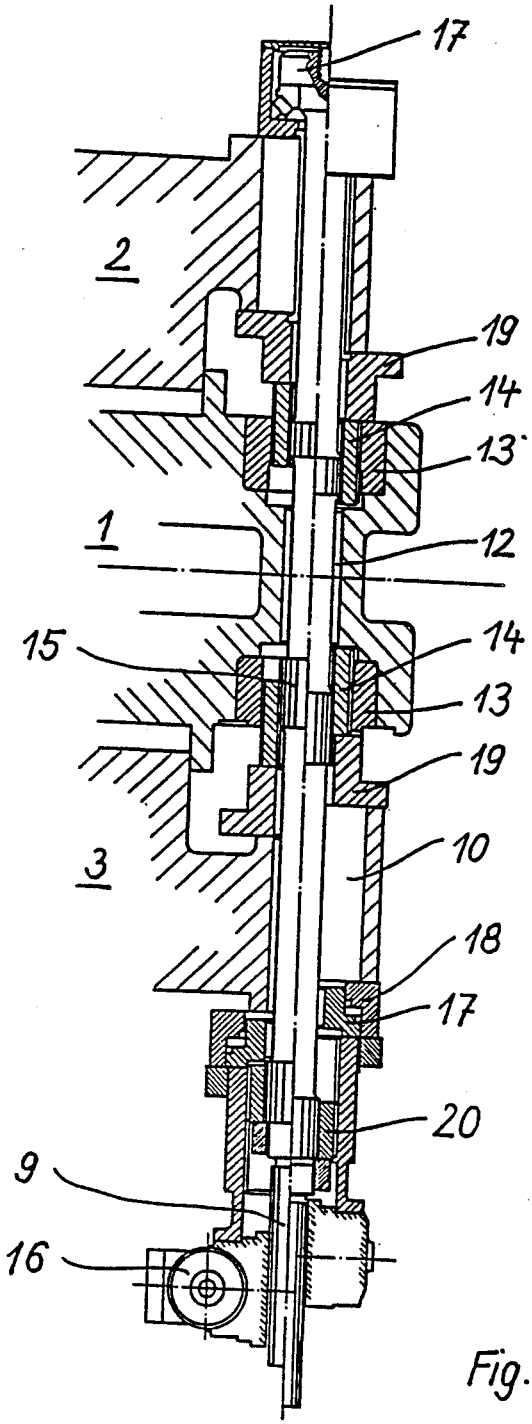
FIG. 3 is a cross-sectional view through the roll stand in the region of a tie rod.

The positioning of the rolls in vertical direction is achieved by a construction such as shown FIG. 3. The tie rod 9 passes through the upper and lower housing halves 2 and 3 and through central frame 1. In the region of the bore 12 in the central frame and specifically at the ends thereof, nuts 13 are inserted within the central frame 1, the nuts being provided with identical, but opposite internal threads. Threaded bushings 14 move within said nuts 13, the movement taking place in opposite direction when they are turned due to the difference in thread pitch. In the region of the axial movement path of the threaded bushings, there are provided multi-wedge shaft profiles 15 on the tie rod 9 so that an axial movement of the threaded bushings 14 can be produced by turning the tie rod. A drive motor and positioning gear 16 at one end of the tie rod serves to turn the tie rod; the other end 17 of the tie rod is developed as abutment or thrust bearing.

At the end of the tie rod 9 adjacent the drive motor 16, a hydraulic piston 17 is provided for the application of pretensioning forces. The piston 17 cooperates with the hydraulic cylinder 18 and, upon being acted on by pressure fluid, applies a tensioning force to the tie rod 9 in order to clamp the housing halves 2 and 3 to each other.

The adjustment of the housing halves 2 and 3 with respect to each other takes place in the manner described below:

By relieving the hydraulic cylinder 18 of the pressure fluid the tie rod is relieved of stress. It can now be turned by means of the drive motor 16, the threaded bushings 14 being turned and moved in axial direction by means of the multi-wedge shaft profile 15. The end sides of the threaded bushings 14 press against support rings 19, which in turn press the housing halves 2 and 3 apart. The lower end of the tie rod is held by a threaded bushing 20 and corresponding thread so that the lower housing half 3 does not fall down due to its own weight.

Upon reaching the desired positioning by turning the tie rod and axial displacement of the threaded bushings 14, pressure is again applied to the hydraulic cylinder 18 and the roll stand is pre-tensioned with the desired pre-tensioning force.

In relieved condition of the tie rod 9, the swivel or swing drives 11, which are shown in FIGS. 1 and 2, for the housing halves, can be actuated, their movement being blocked by the clamping of the housing halves during the rolling.

Figures 4, 5:
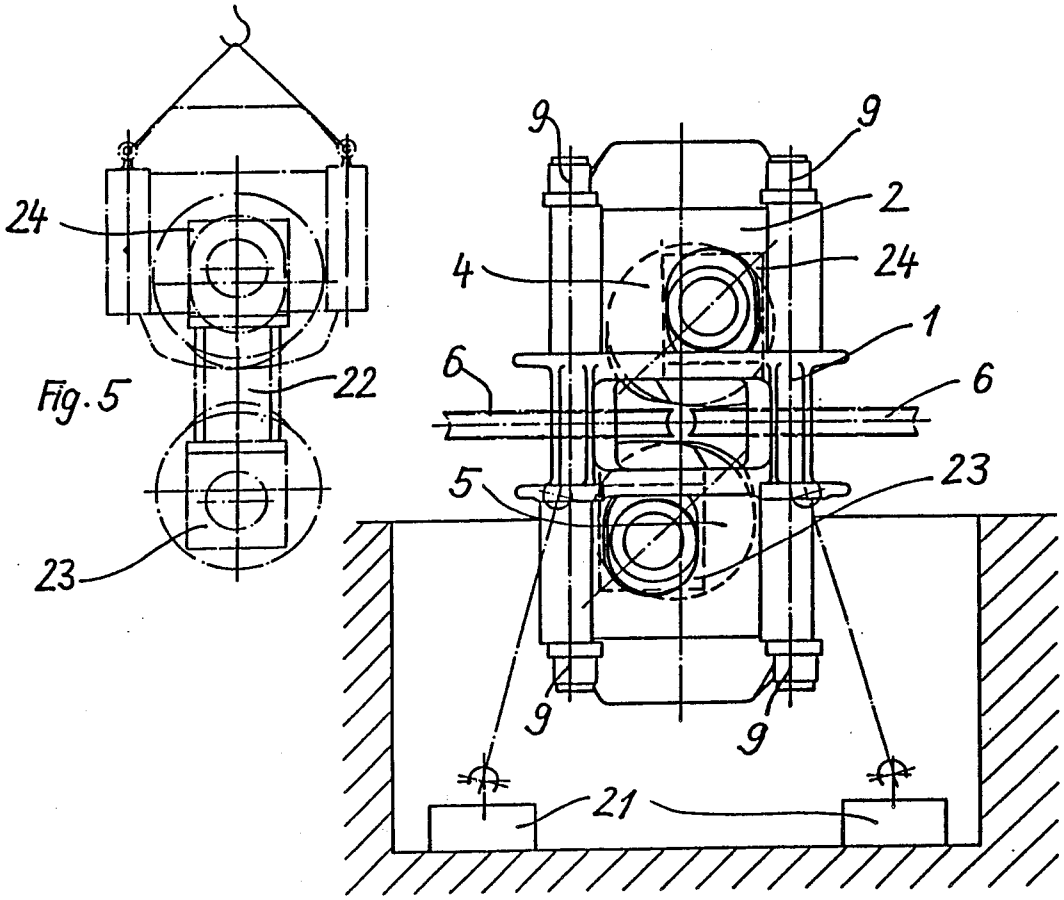
FIG. 4 is a view of the rolling mill according to the invention seen in the direction of rolling.
FIG. 5 is a view of one-half of roll stand with a set of rolls in removed condition.

Identical parts in FIG. 4 have been designated by the same reference numbers. In addition, the drives for the guide disks which are provided below the rolling stand have been given the reference number 21.

FIG. 5 shows, by way of example, how the rolls can be removed in the two-high inclined-roll mill of the present invention. After loosening the tie rods 9, the housing halves 2 and 3 are suitably positioned at a feed angle of 0 and the upper housing half 2 is suspended from a hoist and, together with the upper roll 4 and the lower roll 5 which is attached thereto by means of a connecting element 22, pulled out in upward direction from the lower housing half 3 and the center frame. A correspondingly prepared new set of rolls can be inserted in the same manner so that the replacement times for the roll stand can be kept very short and the expense for changing the roll stand are very slight.

Since these as well as further embodiments and modifications thereto are intended to be within the scope of the present invention, the above description should be construed as illustrative and not in a limiting sense, the scope of the invention being defined solely by the following claims.

What is claimed is:

1. A two-high inclined-roll mill for the piercing and stretching of a solid and hollow work piece along a rolling axis comprising:

a stationary central frame (1) for connection to a foundation (7);

two housing halves (2, 3) supported by and mounted to said central frame;

a pair of rolls (4, 5) defining therebetween a feed angle and each being displaceably mounted in said respective housing half; and means comprising pre-tensioned tie rods for connecting said housing halves to said central frame and for movement of said housing halves relative to each other and around a common axis (A—A) perpendicularly intersecting said rolling axis (8) so as to effect adjustment of said feed angle of said rolls.

2. The inclined-roll mill according to claim 1, wherein said housing halves additionally comprised bores therein and wherein said pre-tensioned tie rods (9) are passing through said bores in said housing halves (2, 3) on both sides of said rolling axis (8) of said work piece being rolled; said bores having a larger diameter than said tie rods resulting in lateral play between said tie rods and said bores (10) for permitting said movement of said housing halves (2, 3) around said common axis (A—A).

3. The inclined-roll mill according to claim 2, wherein said tie rods (9) passing through and connecting said housing halves (2, 3) are stay bolts which are fastened to said central frame (1) on both sides thereof.

4. The inclined-roll mill according to claim 2, wherein said tie rods (9) passing through said central frame are rotatably mounted therein; said tie rods additionally comprising threads having different direction of pitch at both ends of said tie rods in the region of said bores of said housing halves passed through thereby; and located in said housing halves (2, 3) adjusting nuts having corresponding counter threads.

5. The inclined-roll mill according to claim 2, additionally comprising threads having different direction of pitch and being located within said bore (12) in said central frame (1) and within the region of the ends thereof facing the housing halves (2, 3); threaded bushings (14) disposed rotatably and axially displaceably within said threads in said bore and having corresponding external threads therein; multi-wedge profiles (15) on said tie rods (9); the inside of said threaded bushings (14) corresponding with said multi-wedge profiles (15) on said tie rods (9); said tie rods (9) being rotatably mounted for displacement in opposite direction of said threaded bushings (14); the end sides of said threaded bushings (14) acting on said housing halves (2, 3) so as to effect a reciprocating movement thereof; and a piston-cylinder unit (17, 18) cooperating with at least one end of said tie rod (9) for applying a pre-tensioning force to said housing halves.

6. The inclined-roll mill according to claim 1, additionally comprising means (11) resting on said foundation (7) for synchronously opposite turning of said housing halves (2, 3).

7. The inclined-roll mill according to claim 1, wherein said central frame (1) additionally comprises guides for the work piece being rolled.

8. The inclined-roll mill according to claim 7, wherein said guides comprise entrance guides, exit guides, lateral guides and swivel arms for Diescher disks (6).

9. The inclined-roll mill according to claim 1, wherein a least one of said rolls (4 or 5) is connected to one of said housing halves (2, 3) so that after disconnecting said housing halves said roll is removed together with said corresponding housing half (2, 3).

10. The inclined-roll mill according to claim 1, wherein both rolls are connected to one of said housing halves (2, 3) so that both rolls (4, 5) are removed together with one housing half.

11. The inclined-roll mill according to claim 1, wherein the plane of separation between said housing halves (2, 3) is horizontal.

12. The inclined-roll mill according to claim 1, wherein the plane of separation between said housing halves (2, 3) is vertical.

* * * * *